US007254982B2

(12) United States Patent
Frenken

(10) Patent No.: US 7,254,982 B2
(45) Date of Patent: Aug. 14, 2007

(54) ELECTROHYDRAULIC PRESSING DEVICE AND METHOD FOR OPERATING THE SAME

(75) Inventor: Egbert Frenken, Heinsberg (DE)

(73) Assignee: Gustav Klauke GmbH (DE)

( * ) Notice: Subject to any disclaimer, the term of this patent is extended or adjusted under 35 U.S.C. 154(b) by 217 days.

(21) Appl. No.: 10/511,126

(22) PCT Filed: Apr. 7, 2003

(86) PCT No.: PCT/EP03/03586

§ 371 (c)(1),
(2), (4) Date: Jan. 28, 2005

(87) PCT Pub. No.: WO03/084719

PCT Pub. Date: Oct. 16, 2003

(65) Prior Publication Data

US 2005/0120770 A1 Jun. 9, 2005

(30) Foreign Application Priority Data

Apr. 10, 2002 (DE) ..... 102 16 213

(51) Int. Cl.
*B21D 9/18* (2006.01)
*B21D 7/06* (2006.01)

(52) U.S. Cl. ..... 72/453.15; 72/407; 72/453.16; 72/453.03; 60/477

(58) Field of Classification Search ..... 72/453.15, 72/453.16, 407, 453.03; 60/477
See application file for complete search history.

(56) References Cited

U.S. PATENT DOCUMENTS 2,600,860 A 6/1952 Dupre
3,427,837 A 2/1969 Faulconer
4,956,992 A 9/1990 Undin
5,335,530 A 8/1994 Homm
D383,046 S 9/1997 Moffatt et al.
5,727,417 A * 3/1998 Moffatt et al. ..... 72/453.03

(Continued)

FOREIGN PATENT DOCUMENTS

DE 297 18 204 1/1998

(Continued)

OTHER PUBLICATIONS

International Search Report dated Aug. 1, 2003 which issued in connection with corresponding PCT Application No. PCT/EP03/03586.

*Primary Examiner*—David Jones
(74) *Attorney, Agent, or Firm*—Trexler, Bushnell, Giangiorgi, Blackstone & Marr, Ltd

(57) ABSTRACT

The invention relates to an electrohydraulic pressing device (1) that can be operated using one hand. The device comprises a working head (30), an electric motor (4), a pump (20), a hydraulic reservoir (33), and a gear mechanism (19) extending between the electric motor (4) and the pump (20). A holding area (5) around which a hand is placed is provided and an actuating switch (39) is assigned to this area. The aim of the invention is to improve a pressing device of this type with regard to the handling thereof. To this end, the invention provides that the holding area (5) is formed around the electric motor (4), and the actuating switch (39) is situated between the electric motor (4) and the working head.

15 Claims, 14 Drawing Sheets

U.S. PATENT DOCUMENTS

| | | | | |
|---|---|---|---|---|
| 5,934,136 | A | 8/1999 | Bracher et al. | |
| 6,075,341 | A * | 6/2000 | White et al. | 320/114 |
| 6,220,074 | B1 | 4/2001 | Montminy et al. | |
| 6,415,641 | B1 | 7/2002 | Wagner | |
| 6,446,482 | B1 | 9/2002 | Heskey et al. | |
| 6,453,719 | B1 | 9/2002 | Heskey et al. | |
| 6,532,790 | B2 | 3/2003 | Frenken | |
| 6,619,101 | B1 | 9/2003 | Faucher et al. | |
| 6,668,613 | B2 * | 12/2003 | Lefavour et al. | 72/453.03 |
| 6,769,173 | B2 | 8/2004 | Chadbourne | |
| 6,792,789 | B1 | 9/2004 | Faucher | |
| 6,986,274 | B2 * | 1/2006 | Lefavour et al. | 72/453.16 |
| 7,111,488 | B2 | 9/2006 | Lefavour et al. | |
| 2003/0188566 | A1 | 10/2003 | Lefavour et al. | |
| 2006/0277969 | A1 | 12/2006 | Gregg | |

FOREIGN PATENT DOCUMENTS

| | | | |
|---|---|---|---|
| DE | 201 13 238 | U1 | 11/2001 |
| EP | 0 389 716 | A1 | 10/1990 |
| EP | 0 676 835 | A2 | 10/1995 |
| EP | 0 860 245 | A2 | 8/1998 |
| EP | 0 941 813 | | 9/1999 |
| EP | 1 337 016 | | 8/2003 |
| WO | 2006/132820 | | 12/2006 |

* cited by examiner

ELECTROHYDRAULIC PRESSING DEVICE AND METHOD FOR OPERATING THE SAME

RELATED/PRIORITY APPLICATION

This application is a National Phase filing regarding International Application No. PCT/EP03/03586, which relies upon German Application No. 10216213.1 for priority.

FIELD OF THE INVENTION

The invention relates in first instance to an electrohydraulic pressing device suitable for one-handed operation, having a working head, an electric motor, a pump, a hydraulic tank and a gear mechanism between the electric motor and the pump, a gripping region being provided around which a hand can be placed and with which an actuating switch is associated.

BACKGROUND OF THE INVENTION

Apart from the customary electrohydraulic pressing devices which can be operated with two hands, more lightweight embodiments for one-handed operation are known. These are used for example for pressing pipe connections or pressing cable lugs at the ends of electrical lines, a lower pressing force, for example of 3 t, in comparison with the known, heavier two-handed pressing devices being achieved with these one-handed pressing devices.

SUMMARY OF THE INVENTION

With regard to the prior art described above, a technical problem of the invention is seen as being that of configuring a pressing device of the type in question for improved handling.

This problem is solved in first instance and substantially by the subject matter of Claim 1, it being provided that the gripping region is formed around the electric motor and the actuating switch is disposed on the working-head side of the electric motor. This configuration results in improved handling of a pressing device in question. Providing for the gripping region to be disposed in the way specified by the invention allows a substantially bar-shaped configuration of the pressing device, whereby it can be held ergonomically advantageously in one hand like a tool. The actuating switch is also disposed ergonomically advantageously on the working-head side of the electric motor, and consequently allows preferred actuation by an index finger or thumb. It also proves to be advantageous for handling that a center axis of the gripping region points in the direction of the working head of the pressing device, coinciding with the center axis of the electric motor or offset from but parallel to the latter.

The invention also relates to a pressing device according to the features of the precharacterizing clause of Claim 1, it being proposed here for improving the handling of such a pressing device that the gripping region is formed at the center of gravity of the device and the actuating switch and an emergency switch are formed lying oppositely on the device, appropriately for placement of an index finger/thumb. This configuration according to the invention results in improved handling of the pressing device, this inventive solution being of significance both on its own and in combination with the characterizing clause of Claim 1. Therefore, the gripping region is formed ergonomically advantageously at the center of gravity of the device, which in the case of a bar-shaped configuration of the pressing device lies for example approximately in the region of the electric motor. It proves to be particularly advantageous for the actuating switch and the emergency switch to be disposed in such a way that the pressing process can be interrupted. Both switches can be actuated by the hand holding the gripping region, the opposing position of the switches having the effect that one switch, preferably the actuating switch, can be actuated preferably by the index finger and the opposing emergency switch can be actuated preferably by the thumb. This has the result that the user can react quickly to an emergency situation by means of thumb actuation.

The following inventive features are developments both of the invention according to Claim 1 and of the invention according to Claim 2, and also additionally of a combination of Claims 1 and 2. It is accordingly possible to provide an electrohydraulic pressing device which, for one-handed operation, forms a gripping region around the electric motor, the actuating switch being disposed on the working-head side of the electric motor, and the gripping region being formed at the center of gravity of the device, the actuating switch and an emergency switch additionally being formed lying oppositely on the device, appropriately for placement of an index finger/thumb. In this respect, it proves to be particularly advantageous if the actuating switch is disposed away from an end face of the electric motor by the width of one to four fingers. Accordingly, the actuating switch can easily be reached without the hand that is carrying the device having to be moved away from the original position. In order to prevent the pressing device from rolling away when it is put down in the case of a substantially bar-shaped configuration, it is further proposed that a one-sided widening of the device is formed at the end opposite from the working head. As a result of this configuration, a means of preventing rolling away is formed on the housing side. It proves to be particularly advantageous in this respect that the widening is partly formed by a storage battery and, in addition, partly by the receiving region for the storage battery on the housing side. It is further proposed that the widening is formed such that it projects to the side on which the actuating switch is formed, whereby the widening protects the actuating switch from being unintentionally actuated when the device is put down. The amount by which the widening protrudes beyond the cross-sectional configuration of the housing, which is bar-shaped in particular in the gripping region, corresponds approximately to one to two thirds of the diameter of the gripping region. It additionally proves to be a significant advantage that the center axis of the electric motor is in line with the axis of a pump plunger. This achieves the desired virtually bar-shaped configuration over the entire longitudinal extent of the pressing device, the gear mechanism that is disposed between the electric motor and the pump also likewise being in line with the axis of the pump plunger and of the electric motor with its center axis. Accordingly, the electric motor, the gear mechanism and the pump are provided such that they are disposed axially one behind the other. In a development of the subject matter of the invention, it is provided that a bypass valve which opens after the maximum pressing force is reached and brings about the return flow of the hydraulic oil into the hydraulic tank is disposed alongside the pump plunger. The bypass valve can be opened when needed by means of the emergency switch, preferably manually, this emergency switch also acting mechanically on the bypass valve. It proves to be particularly advantageous here that a hydraulic tank is disposed approximately in the form of a ring around the pump plunger and/or the bypass valve, thereby achieving short flow paths for the hydraulic oil. To define more precisely the generally bar-shaped configuration of the pressing device, it is provided that the storage battery can be inserted in the axial direction of the electric motor, a center axis of a storage-battery insert projection or a center axis of the receptacle on the housing side also being in line with the center axis of the electric motor. It also proves to be particularly advantageous in this respect that a central axis of the working-head receptacle is aligned in line with a center axis of the electric motor. Accordingly, in a preferred configuration of the pressing device, the central axis of the working-head receptacle, the axis of the pump plunger in the region of the pump, a center axis of the gear mechanism and the center axis of the electric motor and the center axis of the storage-battery insert projection are aligned in line with one another, so that a substantially bar-shaped configuration of the pressing device, which is ergonomically advantageous and conducive to one-handed operation, is achieved by the individual subassemblies being disposed linearly one behind the other in this way.

The invention also relates to an electrohydraulic pressing device having a working head, an electric motor, a pump, a hydraulic tank and a gear mechanism between the electric motor and the pump, a gripping region being provided around which a hand can be placed and with which an actuating switch is associated, and having a working piston for the actuation of a pressing tool. When cable end sleeves or pipe fittings are being pressed, it often proves to be problematical that they are displaced from the desired pressing position while the pressing by means of the pressing device is being carried out. This may make such pressing unusable. To counteract this disadvantage, it is proposed according to the invention that, when the device is actuated, the working piston can be made to move in first instance into a holding position and then, optionally under time control, can be made to move into the pressing position. In this holding position, the workpiece—for example the cable lug—is held in the pressing tool in such a way that the workpiece can still be easily displaced into the desired pressing position. Only after that is the working piston made to move into the pressing position for the actuation of the pressing tool. In the holding position, the force acting on the workpiece is much lower than the maximum pressing force, so that the workpiece is held reliably in the pressing tool without being deformed. As mentioned, the moving into the pressing position may take place with a time delay. However, a configuration in which the moving into the pressing position can be triggered by renewed actuation of the actuating switch is preferred. Also conceivable is an electronic control, in which for example pulse width control of the electric motor controls the moving of the working piston. It may be provided that, in a first step, the electric motor only develops a very low force, that is to say switches itself off when the holding position is reached. In response to renewed actuation of the actuating switch, the actual pressing is then carried out. Furthermore, there is the possibility of skipping the intermediate position of the pressing tool, i.e. the holding position of the same, by continuous actuation of the actuating switch. In a development of the subject matter of the invention, it is provided that the working piston is of a divided form and that, after moving up against a workpiece, in first instance the portions of the working piston are moved against one another. It is further preferred in this respect for the portions of the working piston to be biased by a spring into a position in which they are moved apart from one another. So it may further be provided that the portions of the working piston engage telescopically in one another. The holding position is in this case clearly defined by the portions of the working piston that are biased away from one another moving against one another. The force of the spring biasing the portions away from one another is in this case set such that no force in excess of this, causing the workpiece to be deformed, can be introduced onto the workpiece. The increase in the opposing force on the working piston that is brought about by means of this spring can also be electronically detected. In addition, the sudden increase in the opposing force when the portions move against one another in the holding position allows a clear, electronically detectable switching-off point to be measured. Moreover, there is the possibility of detecting the moving together of the portions by means of a sensor system which brings about switching off of the electric motor. After the holding position is reached, the final moving of the working piston into the pressing position takes place, as mentioned, deliberately by renewed actuation of the actuating switch, the working piston being displaced thereby against a further restoring spring.

The invention also relates to a method for operating an electrohydraulic pressing device having a working head, an electric motor, a pump, a hydraulic tank and a gear mechanism between the electric motor and the pump, a gripping region being provided around which a hand can be placed and with which an actuating switch is associated, and having a working piston for the actuation of a pressing tool. To improve a method of the type in question with regard to the handling of the device, it is proposed that the working piston is made to move in first instance into a holding position and is held there before being made to move into the pressing position, in which holding position the force acting on the workpiece is much lower than the maximum pressing force. As a result of this configuration, before the final pressing of the workpiece, it can be displaced into the desired pressing position while still in the held position. The force acting thereby on the workpiece is set such that the workpiece is securely held in the pressing tool. The force does not have a deforming effect on the workpiece. In the case of a pressing force of 3 t for example, a holding force which corresponds approximately to one hundredth to one tenth of the pressing force may be chosen. The moving into the pressing position may take place with a time-controlled delay. However, a solution in which the moving into the pressing position is triggered by renewed actuation of the actuating switch is preferred.

Therefore, this movement into the pressing position is only possible deliberately. To permit pressing of a workpiece also without an intermediate stop in the holding position, the continuous movement of the working piston from the basic position into the pressing position can be performed by keeping the actuating switch depressed. However, a solution in which the pressing process is manually interrupted after the holding position is reached is preferred. This means that the moving of the working piston is activated by renewed actuation of the actuating switch. Only a manual interruption of the movement of the working piston makes it stop in the holding position. It is preferred here for the manual interruption to be carried out by actuation of the actuating switch, which brings about the immediate interruption of the advancement of the working piston, in particular in conjunction with an electric motor with a short-circuit brake. It is also conceivable in this respect for an electronically controlled interruption of the pressing process to take place after the holding position is reached. For example, a pulse width control of the electric motor may be provided. In addition, a method in which a sensor system detects the position of the working piston or a portion of the working piston and brings about the switching off of the electric motor in the holding position is also conceivable.

DESCRIPTION OF THE DRAWINGS

The invention is explained in more detail below with reference to the accompanying drawings, which merely represent a number of exemplary embodiments and in which:

FIG. 7 shows a partly sectioned representation of the pressing tool of the first embodiment, in the unloaded basic position;

DETAILED DESCRIPTION Of THE PREFERRED EMBODIMENTS

Figure 1:
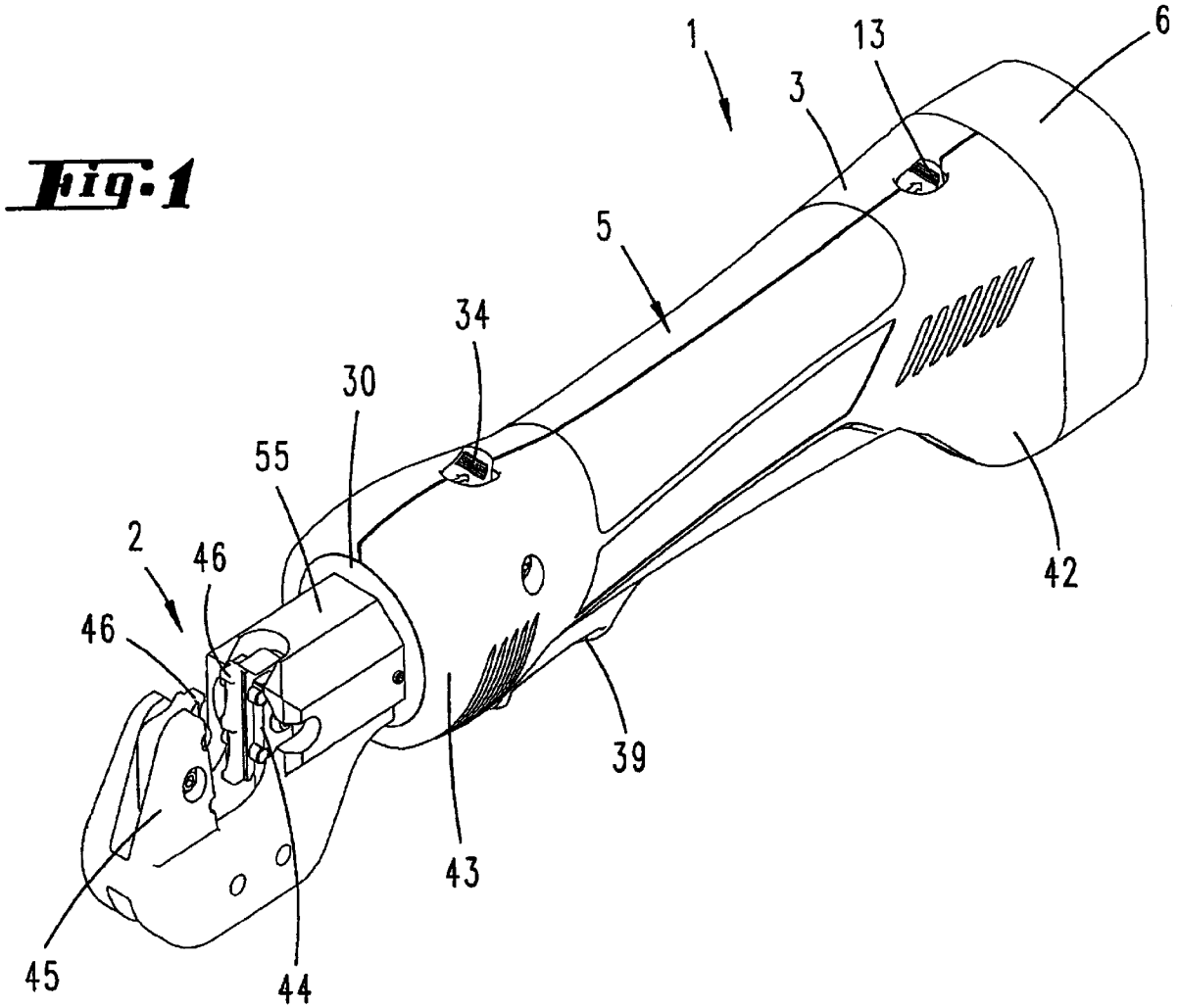
FIG. 1 shows an electrohydraulic pressing device suitable for one-handed operation in a perspective representation, with a pressing tool of a first embodiment.
Figure 2:
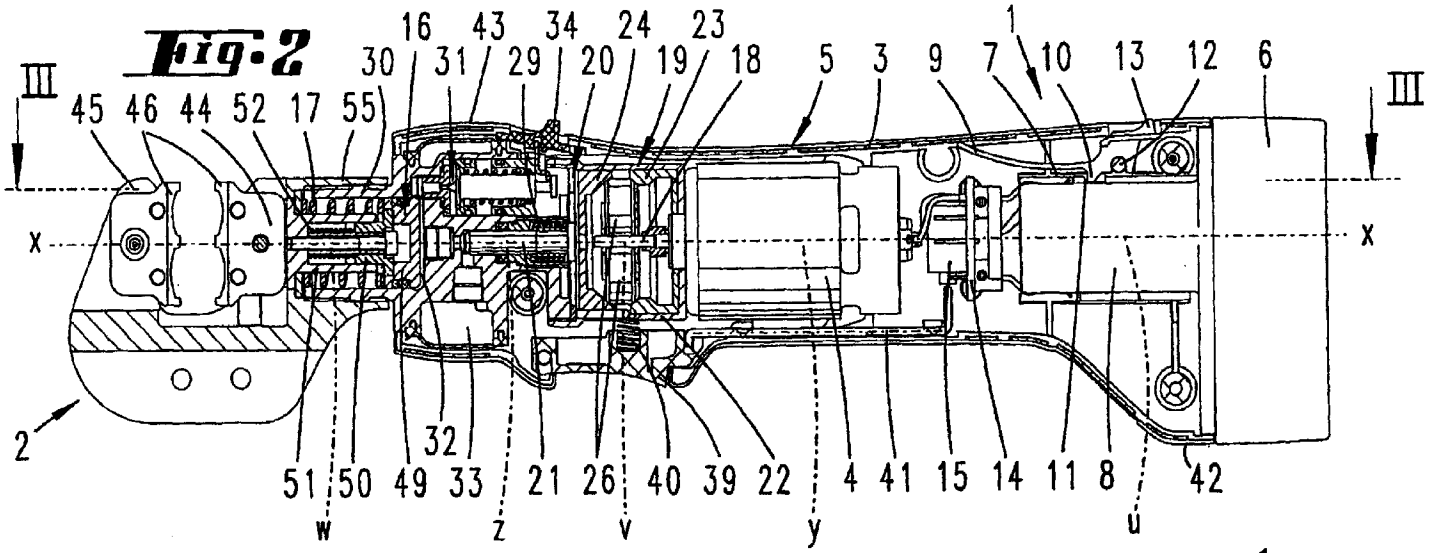
FIG. 2 shows the longitudinal section through the pressing device and the pressing tool.
Figure 3:
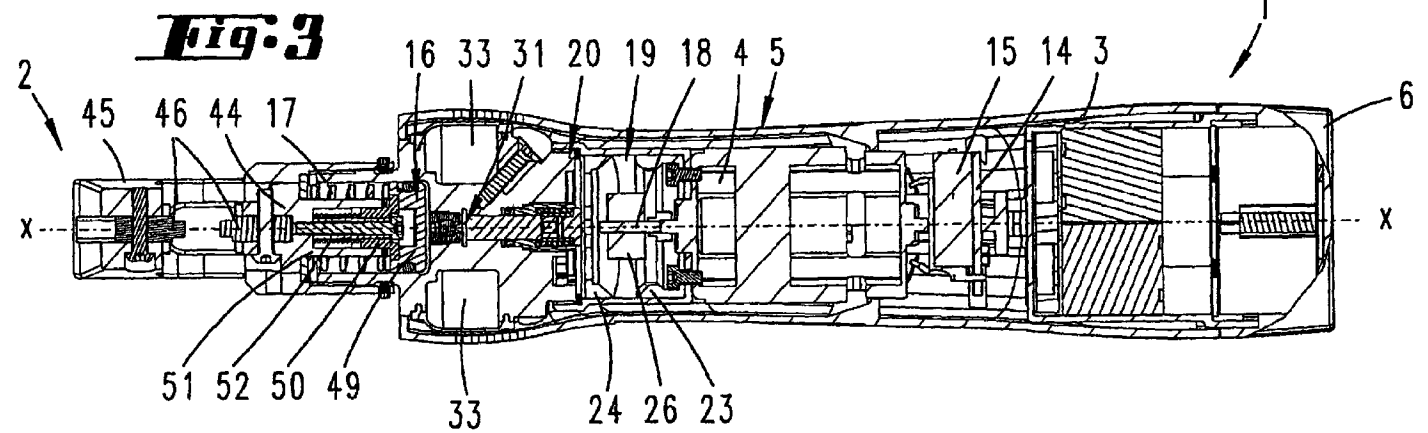
FIG. 3 shows the section along the line III-III in FIG. 2.
Figure 4:
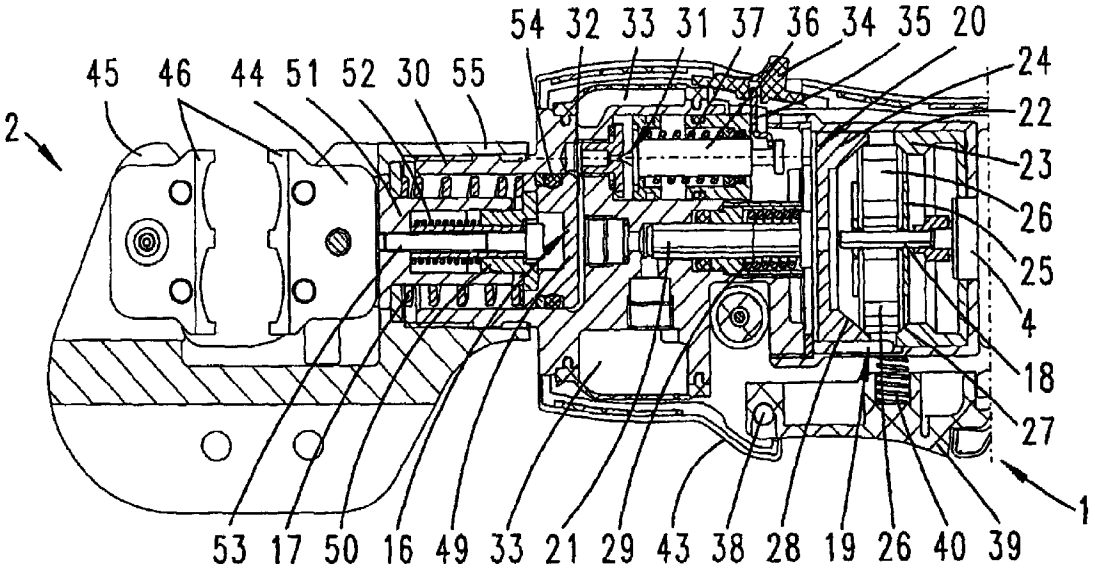
FIG. 4 shows an enlargement of the region on the working-head side taken from FIG. 2.
Figure 5:
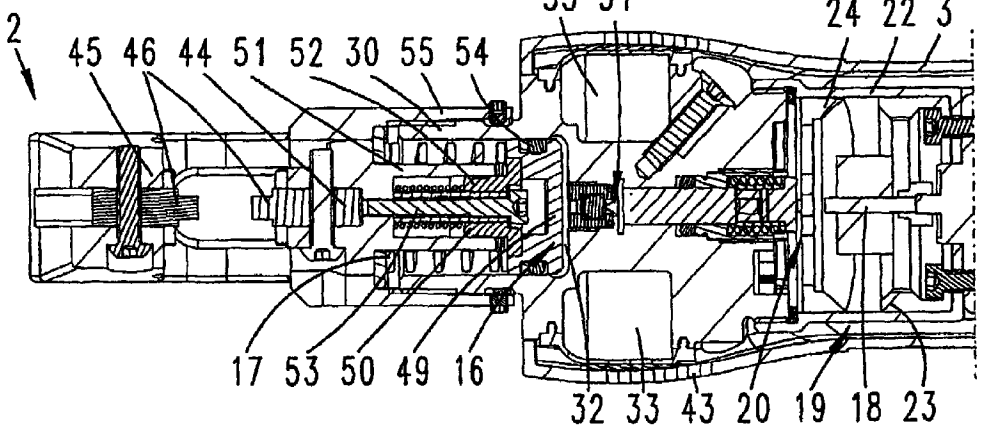
FIG. 5 shows an enlargement of the aforementioned region taken from FIG. 3.
Figure 6:
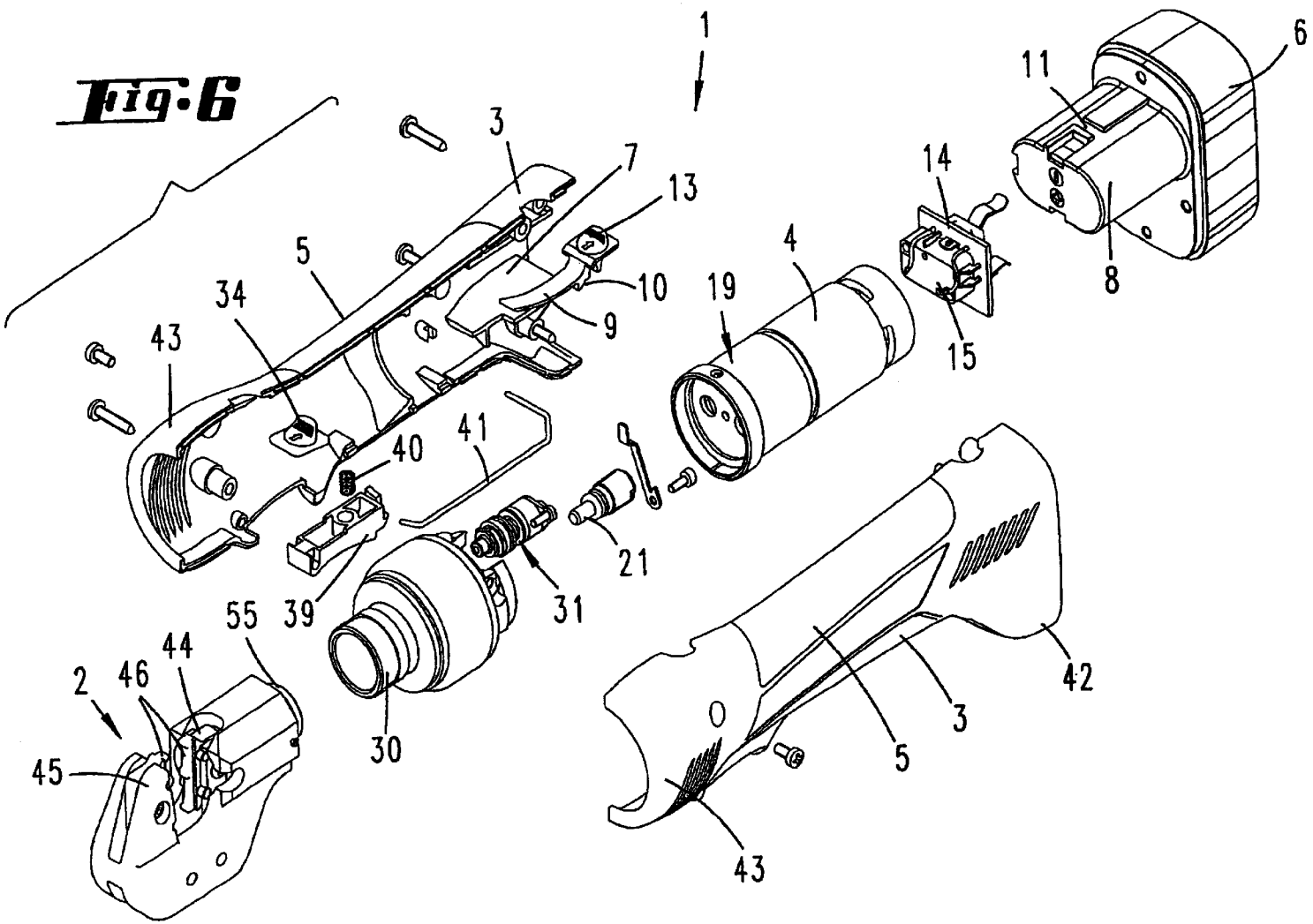
FIG. 6 shows an exploded perspective representation of the pressing device according to FIG. 1.
Figure 4:
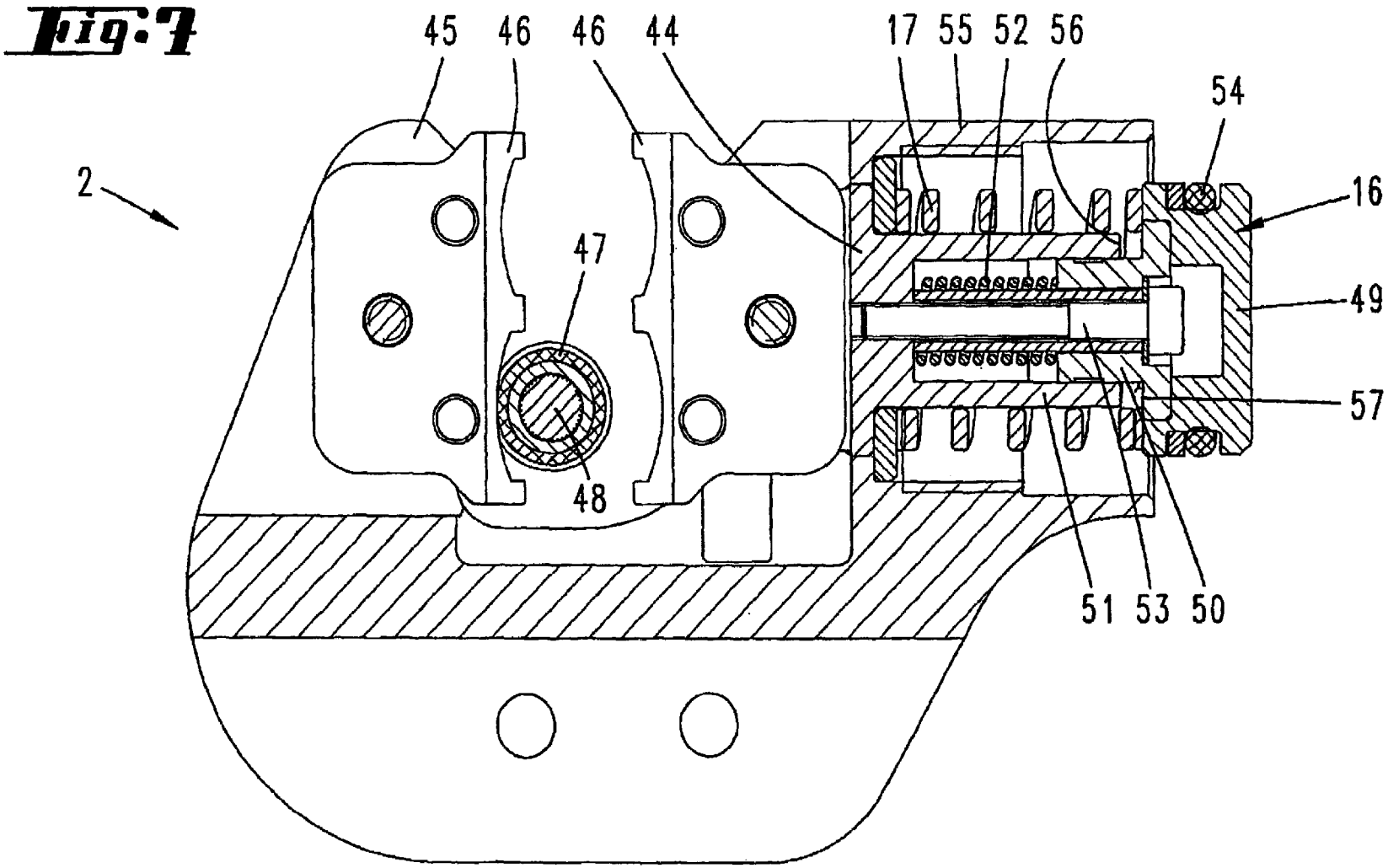

Represented and described, in first instance with reference to FIG. 1, is an electrohydraulic pressing device 1 suitable for one-handed operation, for the actuation of different pressing tools 2. The latter are used for pressing pipe fittings, cable lugs or the like.

As can be seen from the representations, the pressing device 1 is formed substantially in the shape of an elongated bar, which is conducive to the one-handed operation of the device. This bar-shaped configuration is achieved by the individual subassemblies being positioned in the housing 3 of the device 1 such that they are disposed axially one behind the other. So, provided approximately in the central region is an electric motor 4, the center axis y of which is aligned in line with the housing axis x. In the region of the electric motor 4, the housing 3 forms a gripping region 5, the diameter of the housing being chosen to be ergonomically adapted in this gripping region 5.

The electric motor 4 is powered by a storage battery 6, which can be inserted in the axial direction of the electric motor 4. The center axis u of the storage-battery insert projection 8, which can be inserted into a corresponding housing receptacle 7, is positioned in line with the electric motor axis y on the housing axis x.

The inserted storage battery 6 is secured by latching, for which purpose a latching projection 10, which is mounted on a resilient arm 9 and passes through a correspondingly positioned opening in the storage-battery receptacle 7, engages in a latching recess 11 in the insert projection 8.

This latching securement can be released by means of a locking button 13, which can be displaced in the manner of a rocker about an axial body 12 aligned transversely in relation to the longitudinal extent of the pressing device 1. By depressing this locking button 13, the latching projection 10 is pivoted out of the latching receptacle 11, after which the storage battery 6 can be pulled away.

The electrical contacting of the storage battery 6 is not represented. Connected between the latter and the electric motor 4, both electrically and locationally with respect to the disposition within the housing 3, is a circuit board 14, which carries a switch 15 and, optionally, further electronic subassemblies.

By means of the electric motor 4, a working piston 16 is moved in the pressing device 1 in a known manner against the force of a piston return spring 17 by means of an increase in oil pressure, to displace a movable jaw of the pressing tool 2. The working piston 16 and the piston return spring 17 are in this case part of the pressing tool 2.

In order to obtain the oil-pressure-actuated linear displacement of the working piston 16 from the rotational movement of the motor shaft 18, which is aligned on the center axis y of the electric motor 4, a gear mechanism 19 is disposed between the electric motor 4 and a pump 20. The gear mechanism 19 is a rolling gear mechanism, as known from the applicant's German patent application 101 24 267.0, which is not a prior-art publication. The content of this patent application is hereby incorporated in full in the disclosure of the present invention, including for the purpose of incorporating features of this patent application in claims of the present invention.

By means of this gear mechanism 19, the conversion of the rotational movement of the motor shaft 18 driven by the electric motor 4 into an oscillating pumping movement of a pump plunger 21 is achieved. This reciprocating pumping movement takes place in the axial direction of the motor shaft 18, both the center axis v of the gear mechanism and the center axis z of the pump plunger 21 lying in line with the center axis y of the electric motor 5 on the device axis x.

The gear mechanism 19 is substantially made up of a lower track body 23, disposed in a circular-cylindrical casing 22, an upper track body 24 and two driven rotational bodies 26, disposed between the track bodies 23 and 24 and held in a cage 25.

Coaxially aligned in relation to the motor shaft 18 of the electric motor 4, the track bodies 23 and 24 are held in the casing 22 in a rotationally fixed manner. Each track body 23, 24 has tracks 27, 28, which are facing each other.

Disposed between the lower track body 23, facing the electric motor 4, and the upper track body 24, facing away from the electric motor 4, are the driven rotational bodies 26, which are formed in the shape of disks, the rotational axes of these driven rotational bodies 26 being aligned parallel to the center axis y of the electric motor 4 and to the center axis v of the gear mechanism 19.

The driven rotational bodies 26 interact on both sides by their peripheral marginal edges with the respectively associated tracks 27, 28 of the track bodies 23, 24.

The driven rotational bodies 26 are held in a cage 25 in such a way that they lie diametrically opposite each other with respect to the motor shaft 18. The motor shaft 18 passes through the base of the lower track body 23 and centrally through the cage 25, the end of the motor shaft protruding beyond the cage 25 to the rear of it.

The rotational bodies 26 have in each case a shaft engaging surface, formed by the peripheral outer surface. In the same way as the surface of the motor shaft 18, these are formed with a smooth surface, whereby the interaction of the motor shaft 18 and the rotational bodies 26 takes place frictionally.

The tracks 27, 28 of the two track bodies 23, 24 extend at an inclination towards the motor shaft 18, the track 27 of the lower track body 23 forming an acute angle in cross-section with the center axis y of the electric motor 4, as viewed toward the motor-side end of the motor shaft 18, and the track 28 of the upper track body 24 likewise forming an acute angle likewise in cross-section with the center axis y of the electric motor 4, as viewed toward the free end of the motor shaft 18. These acute angles are about 45°.

This configuration of the tracks 27, 28 results in the formation of conical surfaces, with which the peripheral marginal edges of the rotational bodies 26 interact. The upper track body 24 is furthermore held displaceably in the axial direction in the casing 22, this body being biased in the direction of the driven rotational bodies 26. This biasing is achieved by a compression spring 29, acting on the pump plunger 21 and supported on the upper track body 24 on the side facing away from the rotational body.

As a result of this biasing of the upper track body 24, the rotational bodies 26 are always acted upon axially inward, so that the frictional engagement between them and the motor shaft 18 is ensured.

The track 27 of the lower track body 23 is milled from the track body 23 in the form of a circle in plan view. As a result of this, the track engaging surfaces of the rotational bodies 26 interact with a circular running path of the lower track 27. The track 28 of the upper track body 24 on the other hand is produced in a form other than that of a circle, for example by means of a milling cutter, so that an elliptical outline of the upper track 28 is obtained, along with a constant cone angle with respect to the motor shaft 18. As a result of this, the track 28 of the upper track body 24 is structured in terms of height, as seen from the rotational bodies 26, over the circumference with respect to the rotational bodies 26 which interact with it and circulate on a circular path. As a result of the previously described track configurations, the biasing produces an adaptation in terms of height of the upper track body 24 by axial displacement of the same during the circulation of the rotational bodies 26 driven by the motor shaft 18.

The constant rotating travel of the rotational bodies 26 correspondingly brings about an oscillating movement of the upper track body 24 and moreover of the pump plunger 21, which is supported in a spring-loaded manner on the upper track body 24. Accordingly, the track body 24 associated with the gear mechanism 19 at the same time forms part of the pump 20.

By means of this oscillating movement of the pump plunger 21, the already mentioned working piston 16 is subjected to oil pressure by means of a valve system (not represented in greater detail). The working piston 16 lies here in a cylindrical receptacle of a working head 30 on the pressing device side, the center axis w of the hollow-cylindrical working head 30, which is provided with an external thread, being aligned in line with the center axis y of the electric motor 4, and consequently also in line with the further subassemblies and the main device axis x.

Furthermore, a bypass valve 31, which is connected at one end by a line to the pressure space 32 in front of the working piston 16, is provided alongside the pump plunger 21, i.e. offset from but parallel to the pump plunger. This bypass valve 31 automatically opens when a predefined pressure is exceeded in the pressure space 32 and opens a path to the hydraulic tank 33 surrounding the pump 20 or the pump plunger 21 and the bypass valve 31 in the form of a ring. This hydraulic tank 33 is correspondingly disposed in the direct vicinity of the pump 20 on the side of the gear mechanism 19 facing away from the electric motor 4.

The opening of the bypass valve 31 brings about a resetting of the working piston 16 into the unloaded basic position by means of the piston return spring 17.

In addition, the bypass valve 31 can also be manually triggered. Provided for this purpose in the device housing 3, in the direct vicinity of the bypass valve 31, is an emergency switch 34, which is formed as a resetting slide, which when actuated in a sliding manner displaces the valve plunger 36 by way of a driver 35 against the force of a compression spring 37 which acts upon the plunger 36 in the direction of the blocking position.

For switching on the electric motor 4, an actuating switch 39 which can be pivoted about an axial body 38 aligned transversely in relation to the housing axis x, is provided on the side of the device housing 3 that is opposite from the emergency switch 34, which switch, when actuated with a finger, can be pressed against the force of a compression spring 40 supported on the casing 22 of the gear mechanism 19. The button-like actuating switch 39 is disposed here on the working-head side of the electric motor 4 in the region of the gear mechanism 19 and acts via a switch lever 41, which is guided past the electric motor 4, on the switch 15 disposed on the circuit board 14.

As already indicated, the pressing device 1 is formed substantially in the shape of an elongated bar. The gripping region 5 formed around the electric motor 4 is formed at the center of gravity of the device 1 and extends approximately from the end of the electric motor 4 on the working-head side substantially in a cylindrical form into the region of the storage-battery receptacle 7. In this region, the housing 3 goes over into a one-sided widening 42, which widening is partly also formed by the storage battery 6. This widening 42 projects to the side on which the actuating switch 39 is formed. As a result of this configuration, a means of preventing rolling away is provided.

Toward the end on the working-head side, a radially peripheral widening zone 43, formed substantially around the hydraulic tank 33, is likewise provided with respect to the gripping region 5, thereby counteracting slipping of the actuating hand that is holding the gripping region 5 forward in the direction of the working region.

Furthermore, the actuating switch 39 is placed in such a way that it is disposed away from the end face of the electric motor 4 on the working-head side approximately by the width of one to four fingers, and can consequently be easily reached by the index finger of the actuating hand. Moreover, the emergency switch 34 lying opposite can be reached by the thumb of the same hand.

By means of the pressing device 1 described above, conventional pressing tools 2 can be actuated. A first exemplary embodiment of such a pressing tool 2 is represented in FIGS. 1 to 9. This is a C-shaped pressing tool having a sliding jaw 44, which can be linearly displaced by the working piston 16, and a fixed jaw 45 lying opposite. Both jaws 44 and 45 carry pressing inserts 46, for example for pressing a cable lug 47 on a cable end 48.

The working piston 16 is of a two-part divided form, in such a way that a first portion 50, provided with a piston head 49 which can be actuated by oil pressure, engages telescopically into a hollow-cylindrically formed second portion 51, the portions 50 and 51 being biased into a moved-apart position by a compression spring 52 lying in the second portion 51 and supported against the first portion 50.

This biased position is stop-limited by the screw head of a screw 53 which passes centrally through the first portion 50 and the compression spring 52 and is screwed in the base portion of the second portion 51 (cf. FIG. 7).

The piston head 49 has an enlarged cross-section in comparison with the second portion 51, engaging over the first portion 50, and in a conventional manner carries an annular seal 54 in a radially peripheral groove for the sealing of the pressure space 32.

Furthermore, the piston head 49, together with its associated first portion 50, is supported via the piston return spring 17 against the base of the counter-receptacle 55 which is formed on the pressing tool side, engages around the working piston 16 and is provided with an internal thread.

The second portion 51 of the working piston 16 passes with its solid end, opposite from the piston head 49, through the base of the counter-receptacle 55 and is connected to the sliding jaw 44, so that linear displacements of the second portion 51 can be transferred to the sliding jaw 44.

Figure 8:
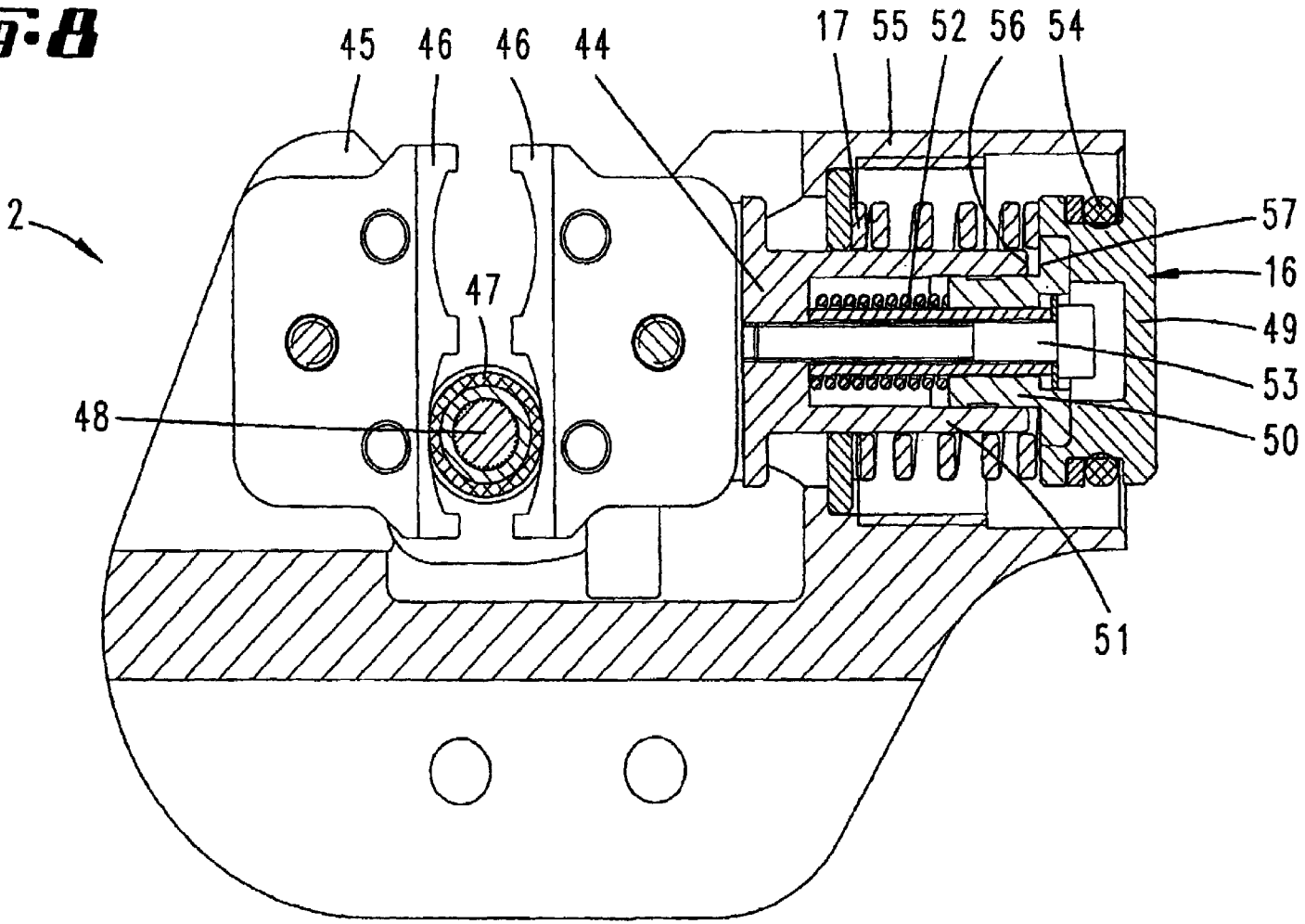
FIG. 8 shows a representation corresponding to FIG. 7, but for the holding position.

The two-part form of the working piston 16 proves to be advantageous to the extent that, as a result, the movable jaw—here the sliding jaw 44—of the pressing tool 2 can in first instance be made to move into a holding position according to the representation in FIG. 8 and can be held there before further movement into the pressing position. The switching on of the pressing device 1 takes place by actuating the actuating switch 39, whereupon the electric motor 4 increases the oil pressure in the pressure space 32 by means of the gear mechanism 19, which has the consequence of a linear displacement of the working piston 16 and, via the latter, of the sliding jaw 44. In first instance, the two portions 50 and 51 remain in their moved-apart position, on account of the compression spring 52 that is provided. As soon as the workpiece to be pressed—here the cable lug 47—is clamped between the pressing inserts 46, this leads to a telescopic movement of the two portions 50 and 51, one into the other, against the force of the compression spring 52, until these portions move against each other. This means that, with increasing oil pressure, no displacement of the sliding jaw 44 takes place over the distance between the free end region 56 of the second portion 51 and the opposite end face 57 of the first portion 50.

This situation can be electronically detected, and the electronic system concerned effects switching-off of the electric motor, so that the user can still displace the clamped workpiece between the pressing inserts 46. It is preferred, however, for the pressing process to be manually interrupted in this holding position—as represented in FIG. 8—by renewed actuation of the actuating switch. If this holding position is not desired, the user can refrain from renewed actuation of the actuating switch 39, whereupon the pressing process is carried out continuously without an intermediate stop.

Figure 9:
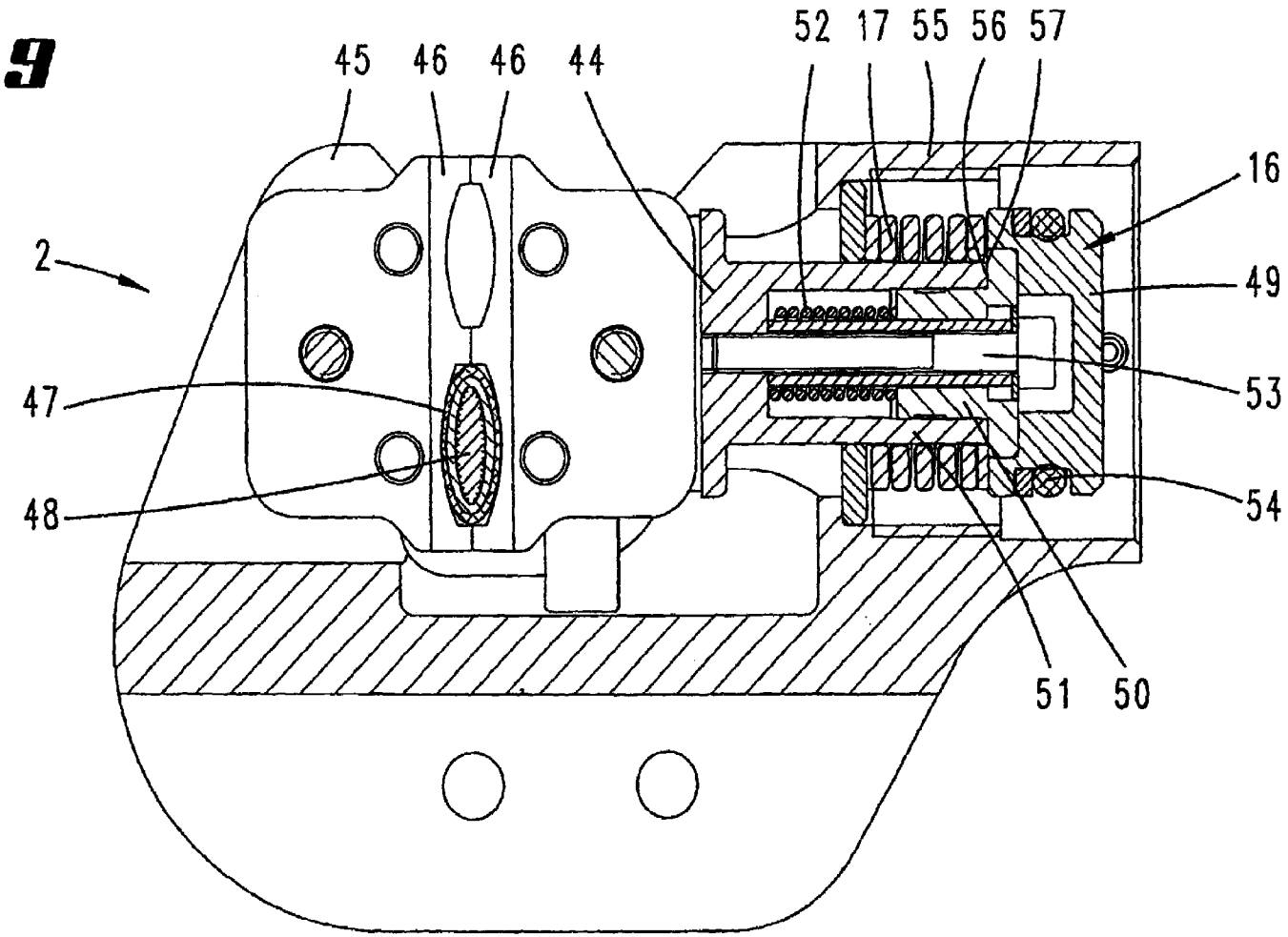
FIG. 9 shows a further representation of the pressing tool, corresponding to FIG. 7, but in the pressing position.
Figure 10:
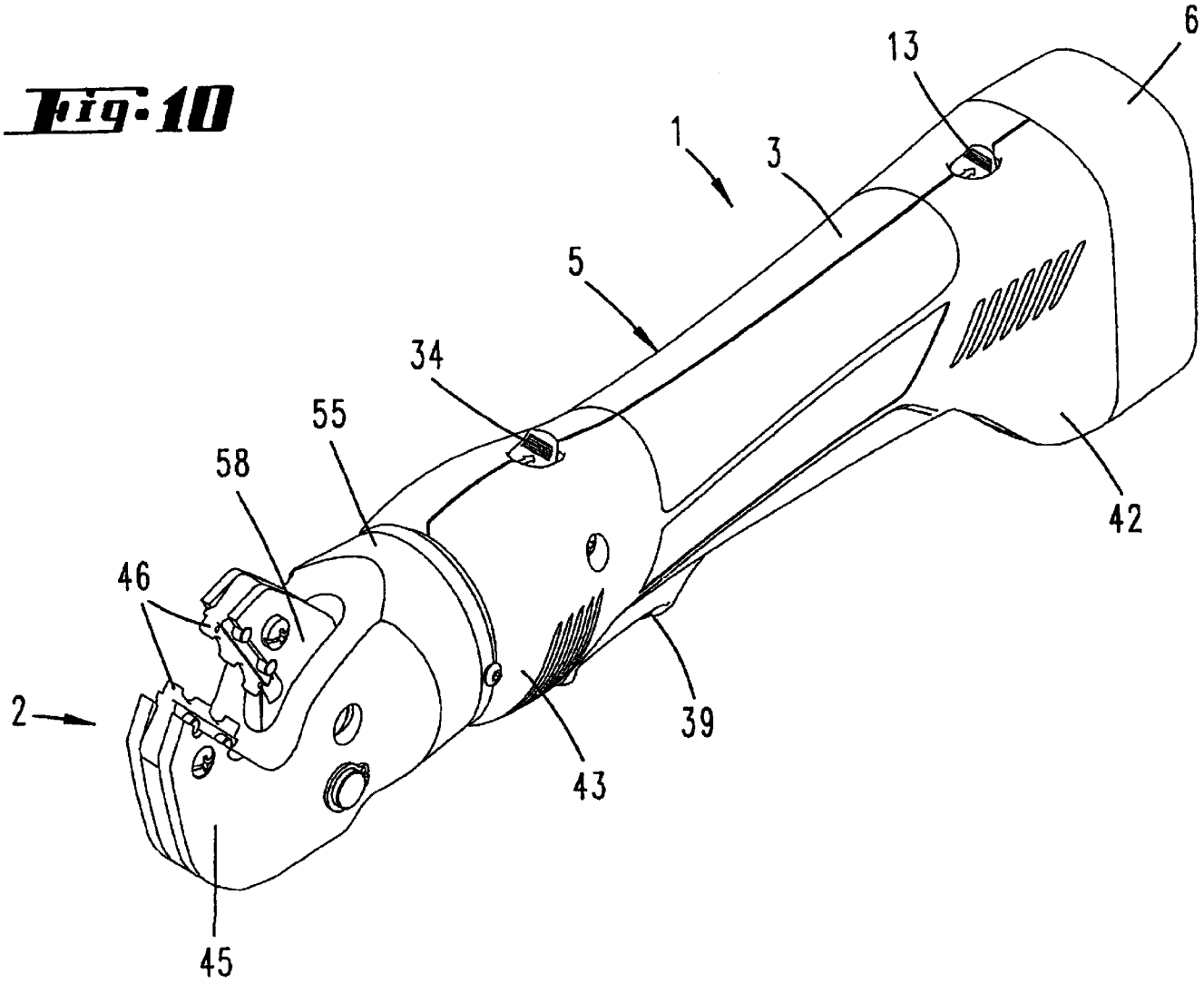
FIG. 10 shows a perspective representation of the pressing device, corresponding to FIG. 1, with a pressing tool in a second embodiment.
Figure 11:
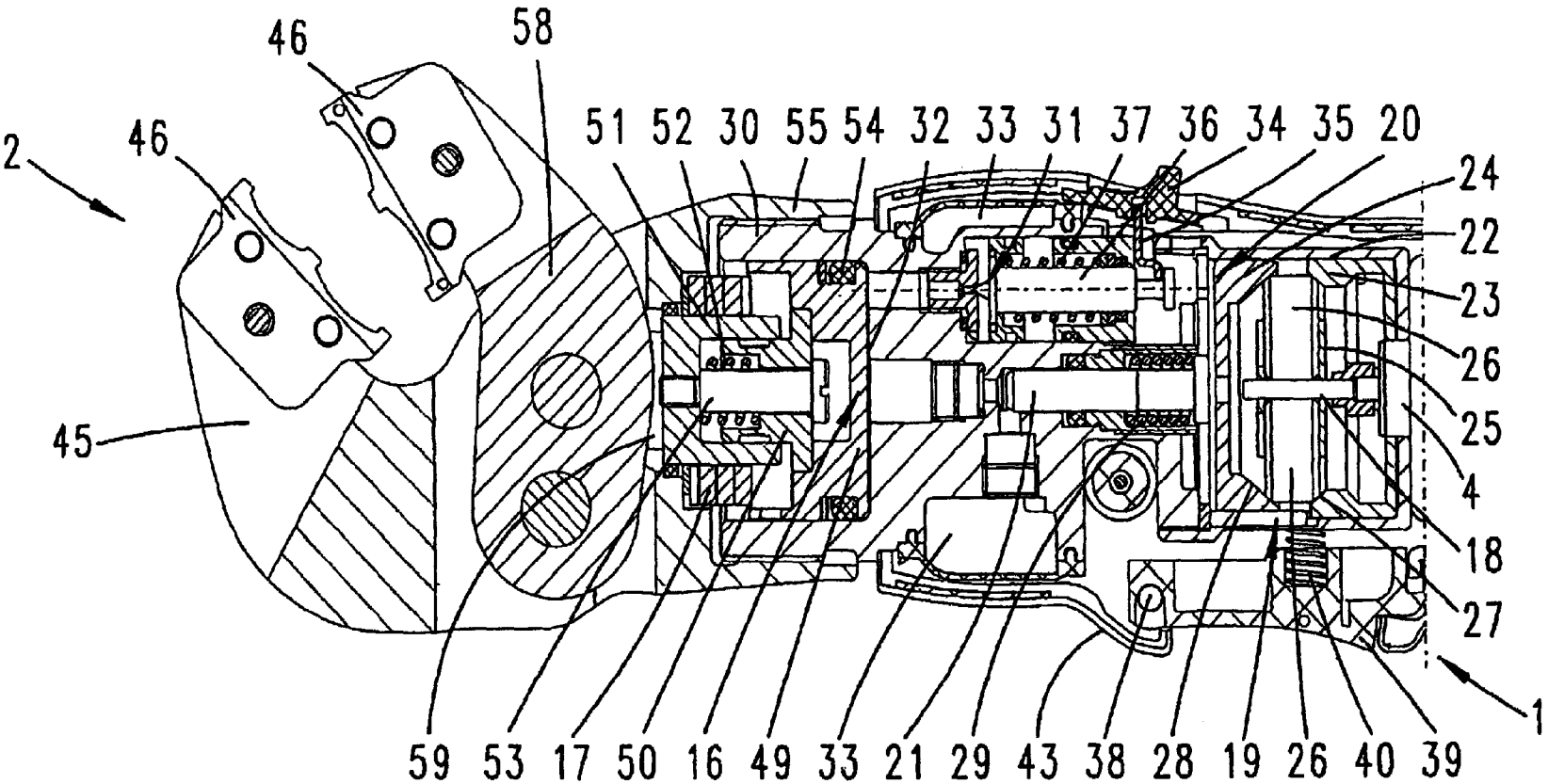
FIG. 11 shows a representation corresponding to FIG. 4, but for the pressing tool according to FIG. 10.
Figure 12:
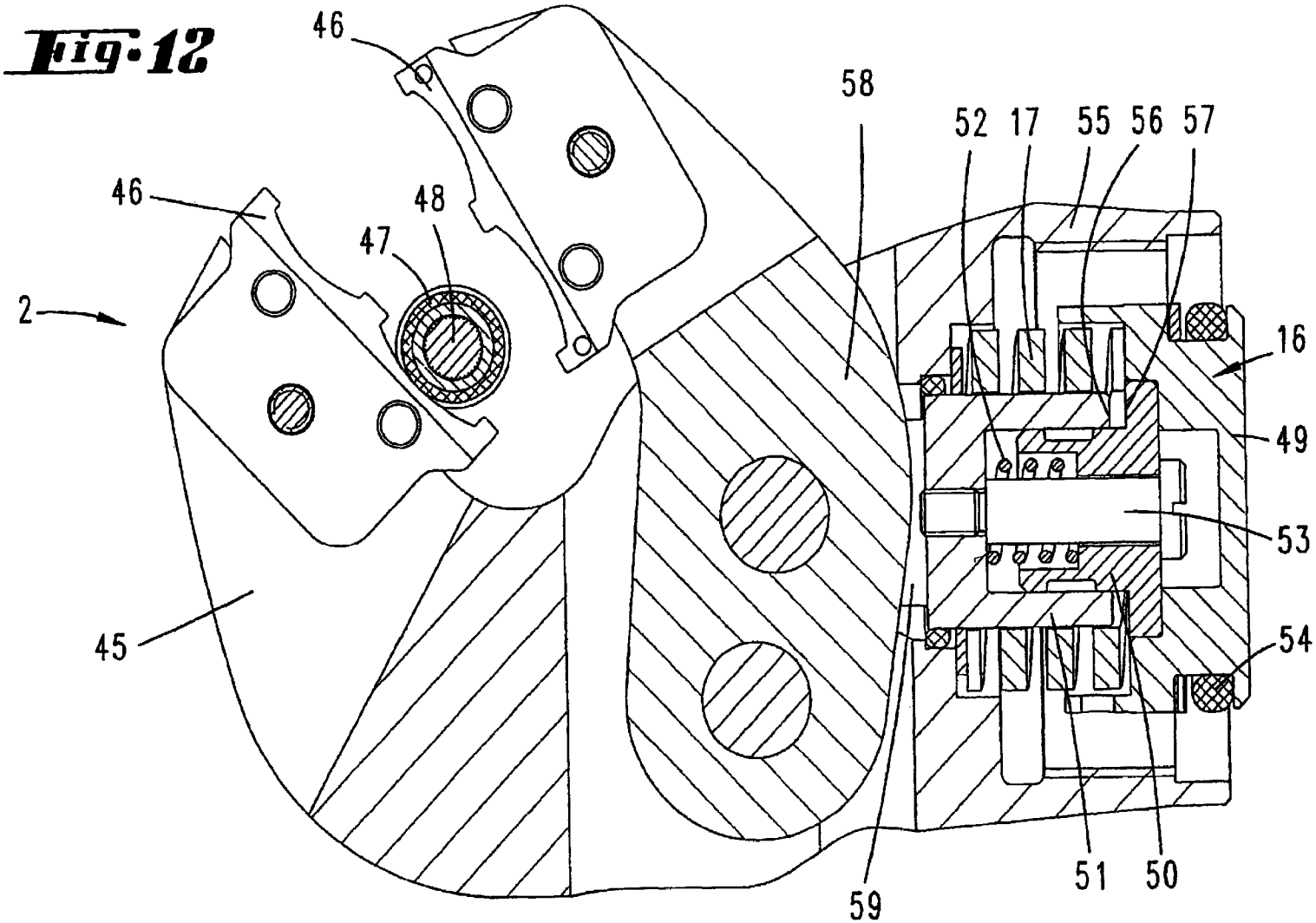
FIG. 12 shows a partly sectioned detail representation of the pressing tool of the second embodiment, in the unloaded basic position.
Figure 13:
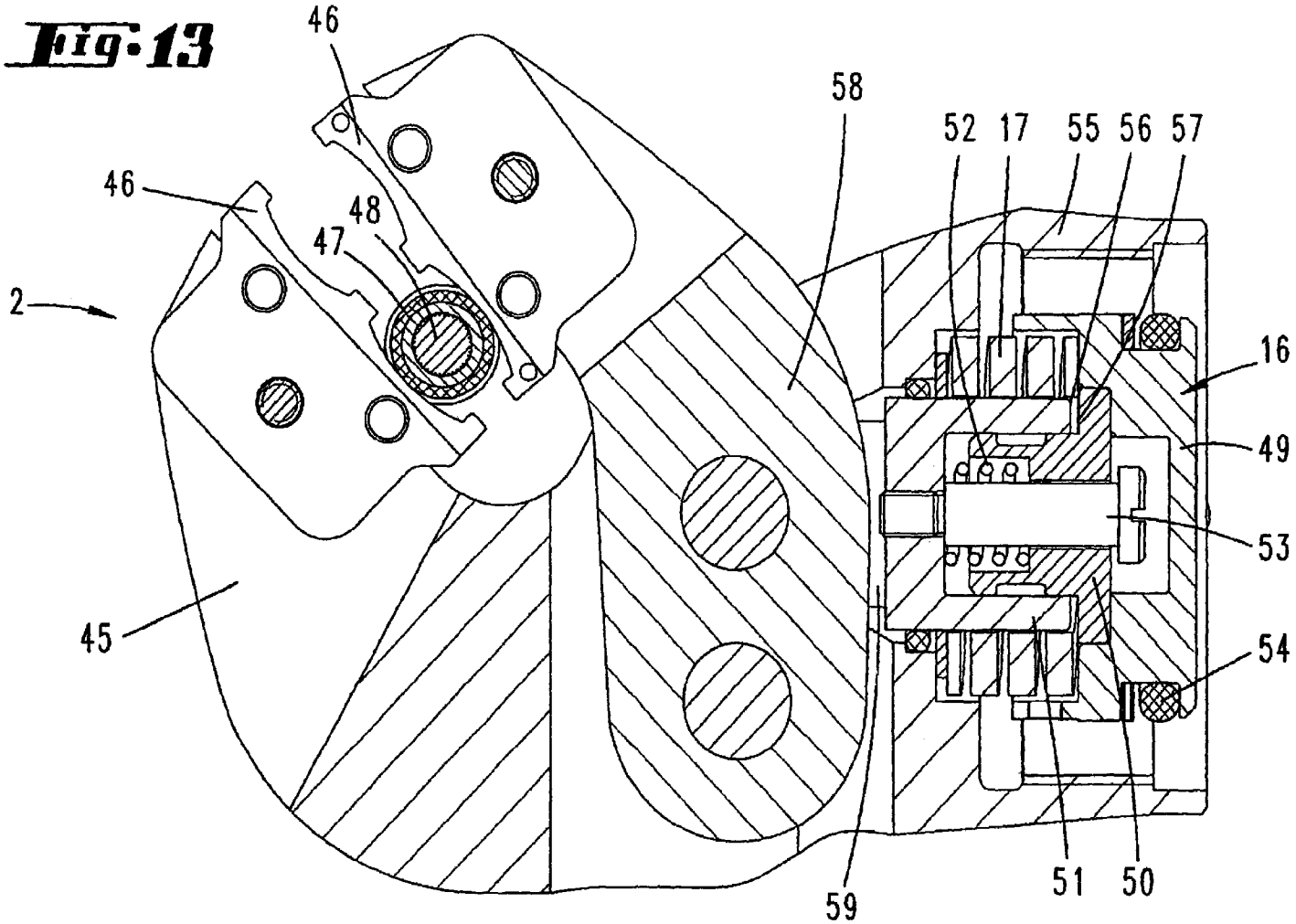
FIG. 13 shows a representation corresponding to FIG. 12, for the holding position.
Figure 14:
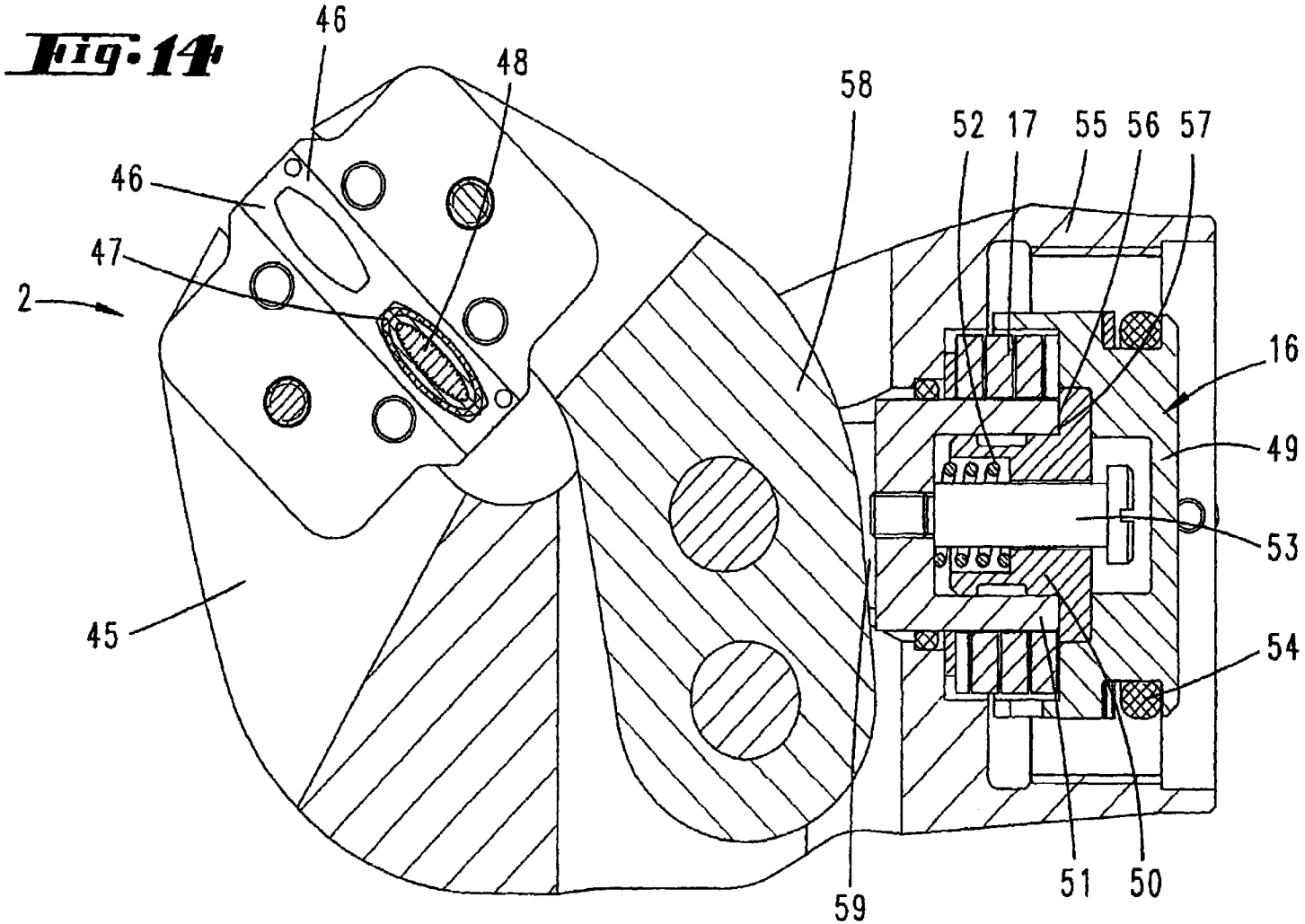
FIG. 14 shows a further representation corresponding to FIG. 12, but for the pressing position.

If staying in the holding position according to FIG. 8 was required, the pressing process can be continued by renewed actuation of the actuating switch 39, movement of the end region 56 of the second portion 51 against the end face 57 of the first portion 50 being followed by the working piston 16 being displaced further against the force of the piston return spring 17 into the pressing position according to FIG. 9.

If a specific pressing force is exceeded, the bypass valve 31 of the pressing device 1 opens automatically, whereupon the working piston 16, supported by the piston return spring 17, is made to move back into the basic position and, as a result of being acted upon by the compression spring 52, the portions 50 and 51 are likewise displaced into the position in which they are spaced apart from one another.

In FIGS. 11 to 14, a pressing tool 2 is represented in a second embodiment. This pressing tool 2 can also be disposed on a pressing device 1 as described above.

According to the exemplary embodiment described above, in this pressing tool 2 two portions 50, 51 are also provided for forming the working piston 16, which portions 50, 51 engage telescopically in one another and are biased into a moved-apart position by means of a compression spring 52.

The pressing tool 2 is formed like a beaked head, with a fixed jaw 45, carrying a pressing insert 46, and a pivotably mounted pivoting jaw 58, likewise carrying a pressing insert 46. This pivoting jaw 58 is pivotally displaced from a basic posit on according to FIG. 12 into a pressing position according to FIG. 14 by means of a lever 59 which is connected to the working piston 16, or to its second portion 51, and acts on the leg of the pivoting jaw 58; a holding position in which the workpiece to be clamped—here also a cable lug 47—is secured in a clamping manner between the pressing inserts 46 is also provided here according to the representation in FIG. 13. In a way corresponding to the embodiment described above, this is achieved by telescopic sliding of the two portions 50 and 51 of the working piston 16 in one another. Only after the end face 57 of the first portion 50 has struck against the end region 56 of the second portion 51 can the further displacement of the pivoting jaw 58 into the pressing position according to FIG. 14 be achieved—preferably by renewed actuation of the actuating switch 39.

Figure 15:
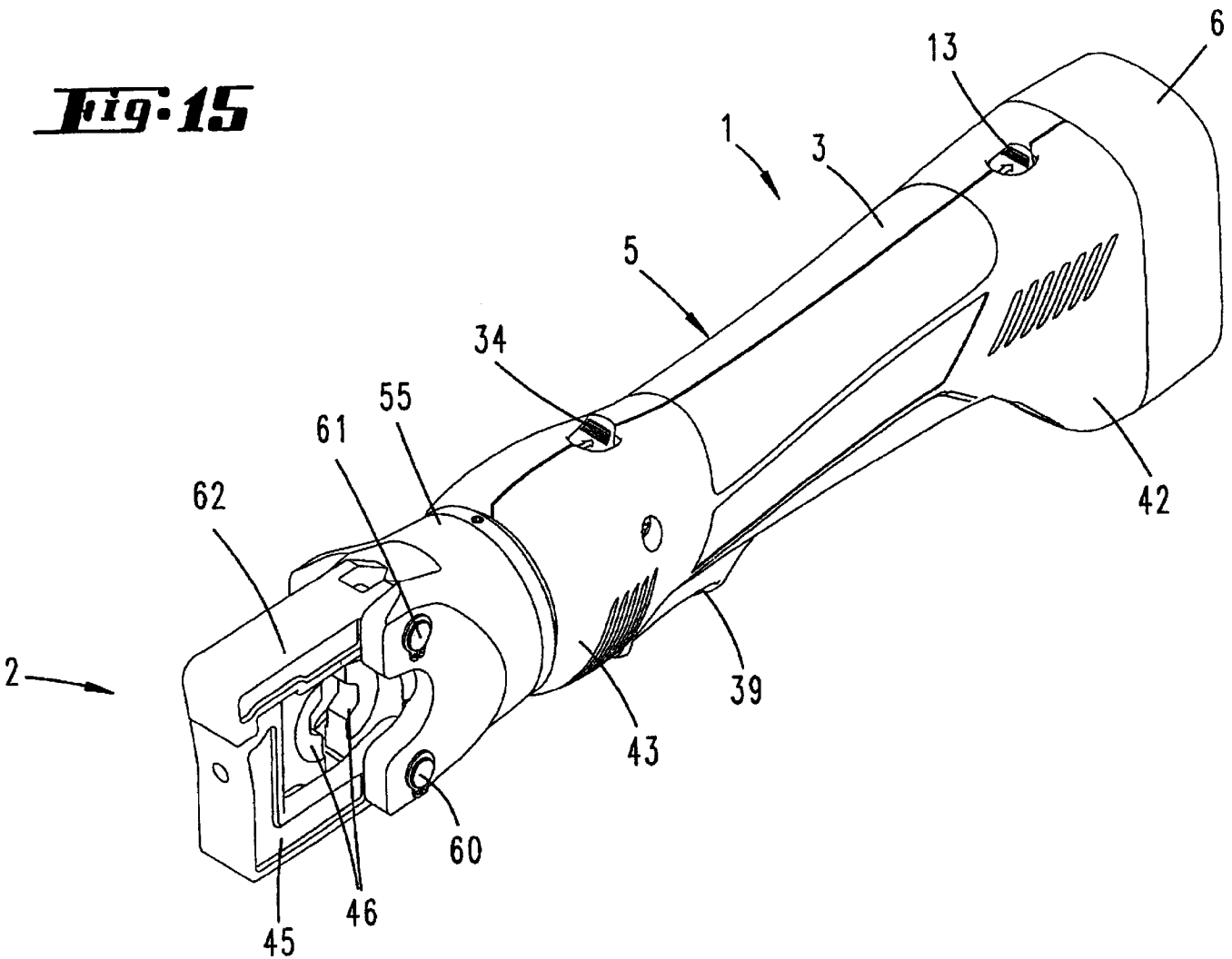
FIG. 15 shows a perspective representation of the pressing device, corresponding to FIG. 1, with a pressing tool in a third embodiment.
Figure 16:
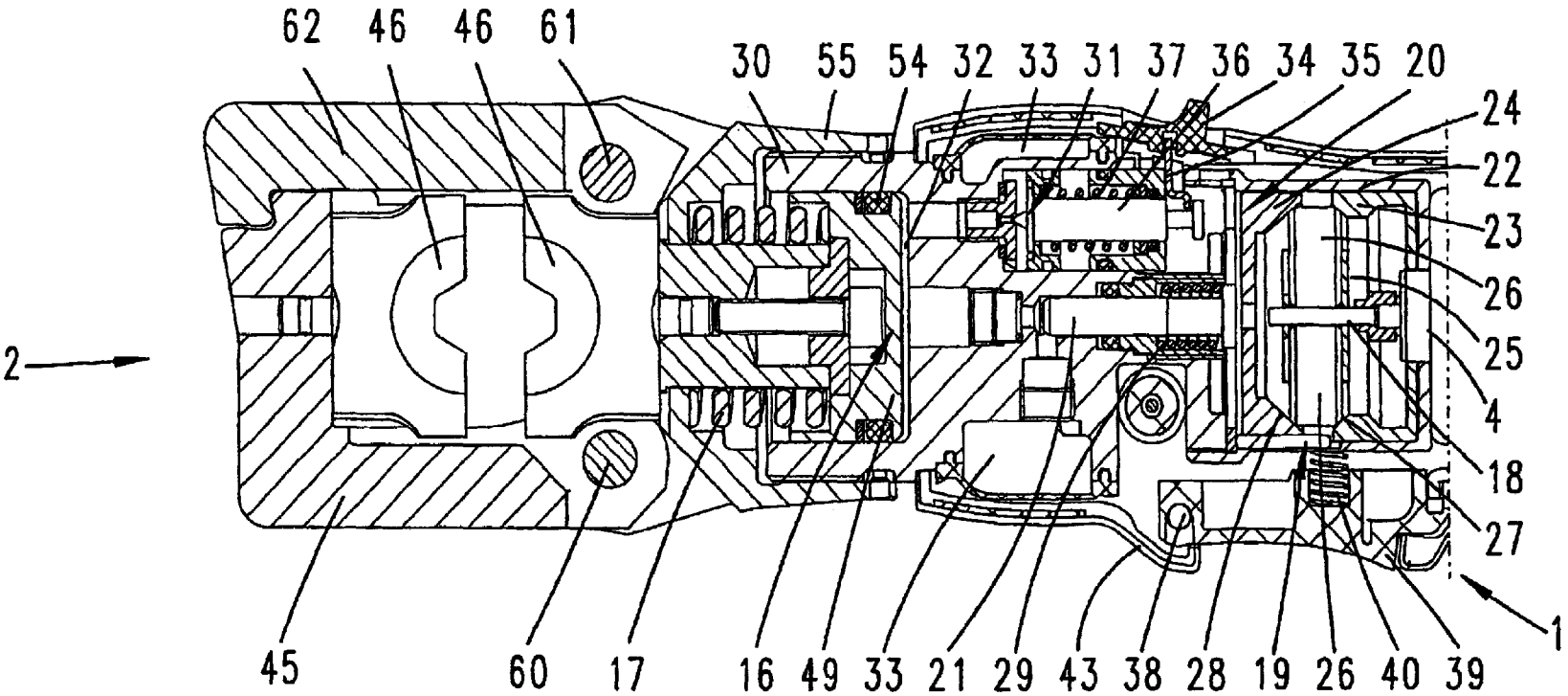
FIG. 16 shows a sectional representation corresponding to FIG. 4, but for the pressing device with a pressing tool according to FIG. 15.

FIGS. 15 and 16 show a further embodiment of a pressing tool 2, which, by contrast with the exemplary embodiments described above, is provided with a one-part working piston 16. Accordingly, no holding position is provided in the case of this pressing tool 2. By increasing the oil pressure, the working piston 16 is displaced continuously from the basic position into the pressing position against the piston return spring 17.

A linearly displaceable sliding jaw 44, which is connected to the working piston 16, has a pressing insert 46 and is displaced against a fixed jaw 45 with a pressing insert 46, is also provided in the case of this pressing tool 2. For setting the pressing tool 2 against the workpiece to be pressed, the fixed jaw 45 can in first instance be pivoted away about a pin 60. After setting it against the workpiece, the L-shaped leg of the fixed jaw 45, which can be pivoted about the pin 60, is pivoted back into its working position and held by means of a securing lever 62, which is displaceable in a pivoting manner about a further pin 61, disposed lying opposite the pin 60.

All features disclosed are (in themselves) pertinent to the invention. The disclosure content of the associated/attached priority documents (copy of the prior patent application) is also hereby incorporated in full in the disclosure of the application, including for the purpose of incorporating features of these documents in claims of the present application.

The invention claimed is:

1. Electrohydraulic pressing device suitable for one-handed operation, comprising:

a housing having a forward end and a rearward end;

a working head attached to said housing, said working head provided at said forward end of said housing;

an electric motor for actuating said working head, said electric motor being rearward of said working head, provided within said housing and being axially aligned with said working head;

a hydraulic tank which houses hydraulic fluid, said hydraulic tank being rearward of said working head and provided within said housing;

a pump for pumping hydraulic fluid from said hydraulic tank to said working head, said pump being rearward of said working head and provided within said housing; and a gear mechanism connected between the electric motor and the pump, said gear mechanism being rearward of said working head and provided within said housing;

said housing defining a gripping region around which one hand of a user can be placed, said gripping region is formed around the electric motor such that in use, the hand of the user at least partially encircles the housing around said electric motor; and an actuating switch for actuating said working head, said actuating switch provided on said housing and being forward of said gripping region such that in use, the hand of the user can actuate said actuating switch while gripping said gripping region.

2. Electrohydraulic pressing device of claim 1, wherein said housing has a center of gravity, and further comprising an emergency switch provided on said housing, the gripping region is formed at the center of gravity of the housing and the actuating switch and the emergency switch are formed lying oppositely on the housing, appropriately for placement of an index finger/thumb.

3. Electrohydraulic pressing device of claim 1, wherein a said rear end of the housing is widened relative to a remainder of said housing.

4. Electrohydraulic pressing device of claim 3, further including a storage battery provided in said housing, wherein widened rear end is partly formed by said storage battery.

5. Electrohydraulic pressing device of claim 3, wherein said actuating switch is formed on a side of said housing, the widened rear end projects to the side of said housing on which the actuating switch is formed.

6. Electrohydraulic pressing device of claim 1, said pump including a pump plunger, and wherein a center axis of the electric motor is in line with an axis of the pump plunger.

7. Electrohydraulic pressing device of claim 6, further comprising a bypass valve provided in said housing and disposed proximate to the pump plunger, said bypass valve passing hydraulic fluid from said working head to said hydraulic tank.

8. Electrohydraulic pressing device of claim 6, wherein said hydraulic tank is disposed around at least the pump plunger.

9. Electrohydraulic pressing device of claim 1, further comprising a storage battery, wherein the storage battery can be inserted in an axial direction of the electric motor.

10. Electrohydraulic pressing device of claim 1, said working head includes a receptacle having a central axis and a piston, said piston being received in said receptacle, said receptacle is aligned in line with a center axis of the electric motor.

11. Electrohydraulic pressing device of claim 1, wherein said pump and said gear mechanism are axially aligned with said working head and said motor.

12. Electrohydraulic pressing device of claim 1, further including a rearward switch provided within said housing rearward of said motor, and a lever extending from said actuating switch to said rearward switch, said lever being within said housing and extending proximate to said motor, wherein said housing around said lever forms a further gripping region and wherein when said actuating switch is actuated, said lever is moved to actuate said rearward switch.

13. Electrohydraulic pressing device of claim 12, further including a circuit board onto which said rearward switch is disposed.

14. Electrohydraulic pressing device suitable for one-handed operation, comprising:

a housing having a center of gravity and defining a forward end and a rearward end;

a working head attached to said housing, said working head provided at said forward end of said housing;

an electric motor for actuating said working head;

a hydraulic tank which houses hydraulic fluid;

a pump for pumping hydraulic fluid from said hydraulic tank to said working head; and a gear mechanism connected between the electric motor and the pump, said electric motor, pump, hydraulic tank and gear mechanism being rearward of said working head and provided within said housing;

said housing defining a gripping region around which one hand of a user can be placed, said gripping region is formed around the electric motor; and an actuating switch for actuating said working head, said actuating switch provided on said housing and being forward of said gripping region; and an emergency switch provided on said housing, the gripping region is formed at the center of gravity of the housing and the actuating switch and the emergency switch are formed lying oppositely on the housing, appropriately for placement of an index finger/thumb.

15. Electrohydraulic pressing device suitable for one-handed operation, comprising:

a housing defining a forward end and a rearward end;

a working head attached to said housing, said working head provided at said forward end of said linear housing, said rear end of the housing is widened relative to a remainder of said housing;

an electric motor for actuating said working head;

a hydraulic tank which houses hydraulic fluid;

a pump for pumping hydraulic fluid from said hydraulic tank to said working head; and a gear mechanism connected between the electric motor and the pump, said electric motor, pump, hydraulic tank and gear mechanism being rearward of said working head and provided within said housing;

said linear housing defining a gripping region around which one hand of a user can be placed, said gripping region is formed around the electric motor; and an actuating switch for actuating said working head, said actuating switch provided on said housing and being forward of said gripping region, said actuating switch is formed on a side of said housing, the widened rear end projects to the side of said housing on which the actuating switch is formed.

* * * * *